US005934571A

United States Patent [19]

Schmidt et al.

[11] Patent Number: 5,934,571

[45] Date of Patent: Aug. 10, 1999

[54] TWO-STAGE FUEL-INJECTION NOZZLE FOR INTERNAL COMBUSTION ENGINES

[75] Inventors: Harald Schmidt, Vienna; Josef Morell, Meuerbach; Heinz Waras; Patrik Raffelsberger, both of Steyr, all of Austria

[73] Assignee: Steyr-Daimler-Puch Aktiengesellschaft, Vienna, Austria

[21] Appl. No.: 08/859,950

[22] Filed: May 21, 1997

[30] Foreign Application Priority Data

May 22, 1996 [EP] European Pat. Off. ..... 96108193

[51] Int. Cl.[6] ..... F02M 61/20

[52] U.S. Cl. ..... 239/533.9; 239/533.12

[58] Field of Search ..... 239/533.3–533.12

[56] References Cited

U.S. PATENT DOCUMENTS

| | | | |
|---|---|---|---|
| 4,168,804 | 9/1979 | Hofmann | 239/533.11 |
| 4,470,548 | 9/1984 | Ushimura | 239/533.3 |
| 4,715,541 | 12/1987 | Freudenschuss et al. | 239/533.4 |
| 4,819,871 | 4/1989 | Kronberger et al. | 239/533.3 |
| 4,846,114 | 7/1989 | List | 239/533.3 X |
| 5,163,621 | 11/1992 | Kato et al. | 239/533.12 |
| 5,242,118 | 9/1993 | Schmidt et al. | 239/533.4 |
| 5,449,121 | 9/1995 | El-Darazi et al. | 239/533.12 X |
| 5,649,665 | 7/1997 | El-Darazi et al. | 239/533.12 X |
| 5,743,470 | 4/1998 | Schlaf et al. | 239/533.9 X |

FOREIGN PATENT DOCUMENTS

| | | | |
|---|---|---|---|
| 0370659 | 5/1990 | European Pat. Off. . | |
| 0413173 | 8/1993 | European Pat. Off. . | |
| 0641931 | 3/1995 | European Pat. Off. . | |
| 2557772 | 6/1977 | Germany | 239/533.12 |

*Primary Examiner*—Lesley D. Morris
*Attorney, Agent, or Firm*—Bachman & LaPointe, P.C.

[57] ABSTRACT

A fuel-injection nozzle consists of a nozzle housing terminating in a nozzle tip, a pintle guided in the housing, the pintle is pressed by spring action against a conical valve seat in the nozzle tip, the conical valve seat has a plurality of spray holes selectively covered by the conical end of the pintle and passing into a blind hole, the corresponding imaginary cylinder surface area (M) which results, along the extension of each spray hole, between the conical end of the pintle and the conical valve seat being smaller at the end of the first phase of the stroke than the cross-sectional area (Q) of the corresponding spray hole. In order further to improve the emission behavior as a whole, the imaginary cylinder surface area (M) is at most 0.3 times the cross-sectional area (Q) of the corresponding spray hole and the entrance zone into the spray hole is rounded with a radius of at least one-tenth the diameter of the spray hole.

6 Claims, 3 Drawing Sheets

Fig. 1
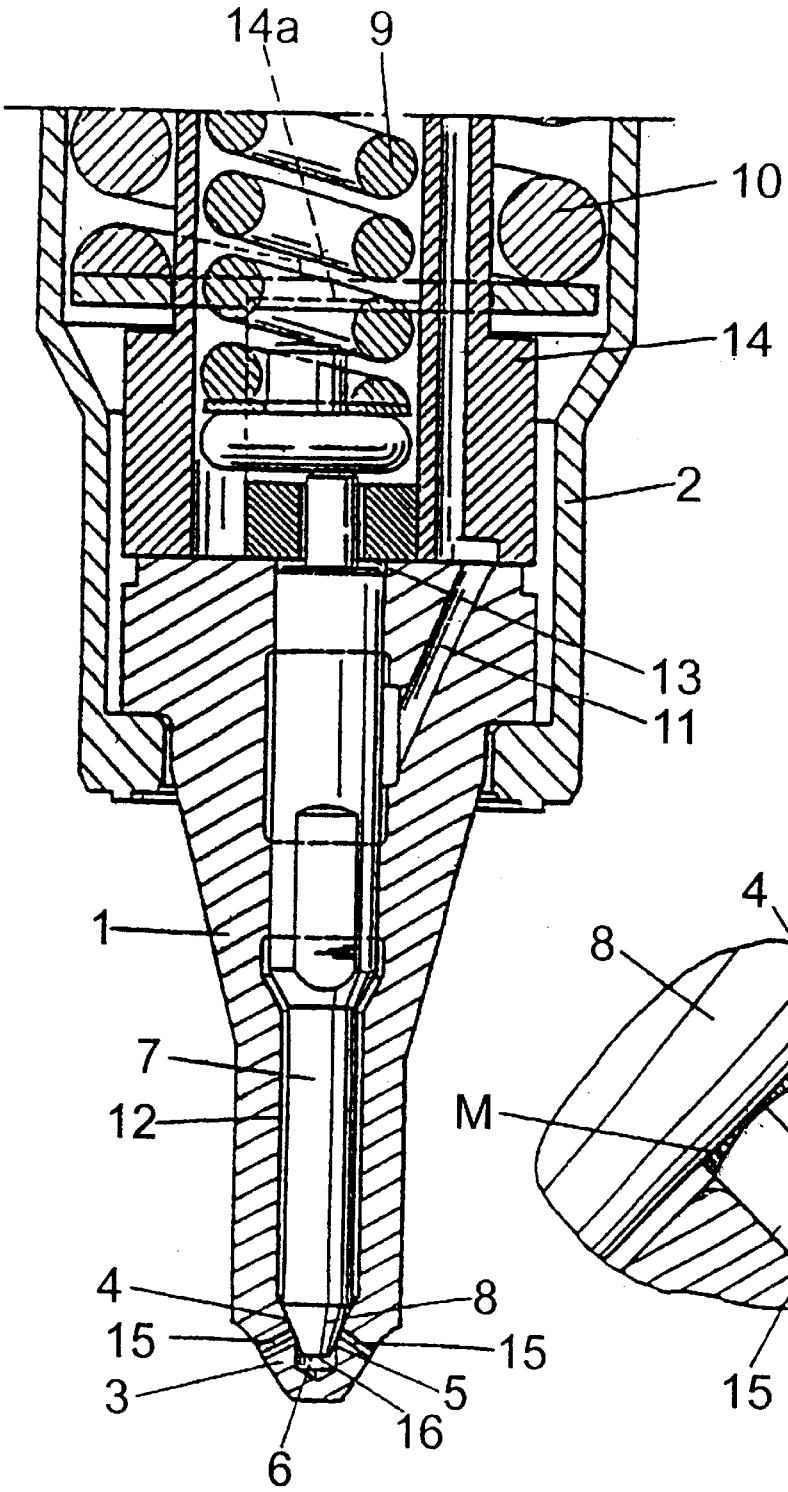
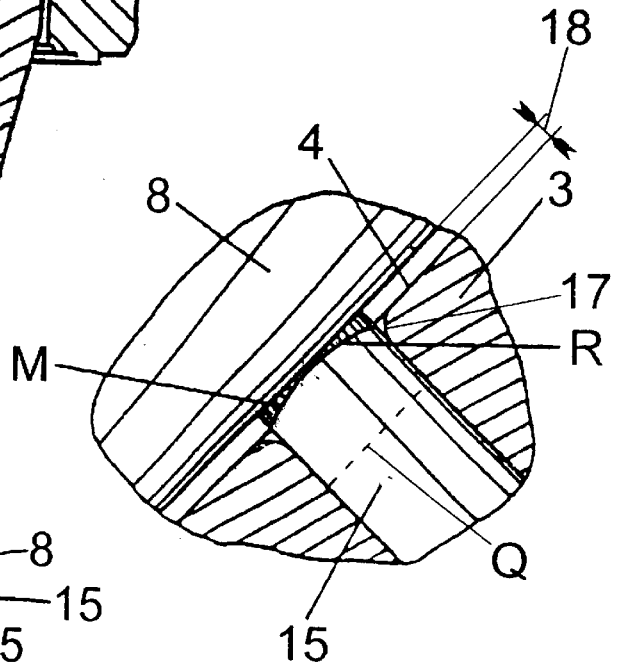
Fig. 2

TWO-STAGE FUEL-INJECTION NOZZLE FOR INTERNAL COMBUSTION ENGINES

BACKGROUND OF THE INVENTION

The present invention relates to a fuel-injection nozzle for internal combustion engines which consists of a nozzle housing terminating in a nozzle tip and a pintle which is guided in said housing and is conical at its lower end, it being pressed under spring action against a conical valve seat in the nozzle tip, the conical valve seat having a plurality of spray holes covered by the conical end of the pintle and passing into a blind hole, the pintle, in a first phase of the stroke lifting off from the valve seat under the pressure of the fuel fed against the force of a first spring and coming against a stop which, in its turn, is displaceable, in a second phase of the stroke, against the force of a second spring, and, at the end of the first phase of the stroke, the corresponding imaginary cylinder surface area which results in the extension of each spray hole between the conical end of the pintle and the conical valve seat is smaller than the cross-sectional area of the corresponding spray hole, as a result of which there is a first deflection of the flow of fuel in the space between pintle and conical valve seat and a following second deflection upon flow into the spray hole.

From U.S. Pat. No. 5,242,118 an injection nozzle of this type is known in which the cylindrical wall surface in the extension of each spray hole is at most 0.75 times the cross-sectional area of the corresponding spray hole. Due to the special conditions of flow caused in part by this, maximum atomization was obtained with such nozzles during the first phase of the stroke and optimal atomization with sufficient penetration in the second phase of the stroke. However, there was room for further improvement with respect to emission and to combustion noises, particularly in the first phase of the stroke. In view of the future maximum exhaust gas values pursuant to EURO III, further improvements and optimization were also necessary. They were achieved in extensive series of tests, and based on hydrodynamic considerations.

With these considerations the following relationships were established: The slight injection rate necessary during the first phase of the stroke requires the smallest possible needle stroke; this produces, in particular, a reduction in the combustion noise. This small needle stroke leads to an increased pressure loss and the atomization is maximum, which, after ignition, leads to increased emission of particles. However, this pressure loss also reduces the penetration, which, on the one hand, results in a reduction in the emission of hydrocarbons (HC-emissions are produced by contact of the fuel with the wall) but, on the other hand, in a non-uniform distribution of the fuel in the combustion air, and thus causes particle emissions. To this extent an enlargement of the needle stroke would be preferable, but this, in its turn, leads to an increase in the combustion noise. Nevertheless, the size of stroke in the first phase cannot be varied as might be desired; the flow and pressure conditions must always permit the development of the special flow pattern with the double deflection in the immediate vicinity of the entrance into the spray hole which is described in detail in U.S. Pat. No. 5,242,118 which represents the prior art. As soon as the conditions change out of the very narrow limits, the special form of flow cannot develop, or it collapses. As a result, all advantages are lost, since the injection cloud then becomes an injection jet, which leads to a sudden increase in the HC and particle emissions.

In addition to this, there is another difficulty when such nozzles are inclined in the customary manner—and therefore in an engine having two valves per cylinder. Since the spray holes are then no longer the same with respect to the nozzle axis, the pressure losses in the entrance zone and the exit zone of the spray holes and in the hole itself are different.

It is thus the object of the invention to find a way out of this dilemma and to improve the nozzle of the prior art in such a manner that the emission behavior as a whole and therefore all emissions including emissions of noise is further improved.

SUMMARY OF THE INVENTION

In accordance with the invention, the foregoing object is achieved in the manner that the imaginary cylinder peripheral surface area amounts to at most 0.3 times the cross-sectional area of the corresponding spray hole and that the entrance into the spray hole is rounded-off with a radius of 8 per cent to 25 per cent of the diameter of the corresponding spray hole.

The cylinder surface area thus becomes particularly low, as a result of which, to be sure, the injection rate is lowered without a substantial increase in the throttle losses but, on the other hand, the boundary-layer flow along the walls has more influence. In order, under these conditions, to still assure the "start" of the double-deflected flow into the spray holes, the given rounding was ascertained.

In this way, several improvements are obtained: Due to the small injection rate, less combustion noise is developed; due to the fact that the flow is still deflected twice, the atomization is extremely fine and due to the relatively high pressure the penetration is nevertheless sufficient for a good mixing, and thus less emission of particles, even in extreme operating conditions, for instance with high pressure in the combustion chamber (the higher density which goes hand in hand with this tends to reduce the penetration).

There is obtained the additional advantage that due to the roundings, the deflection-produced pressure losses with obliquely installed nozzle deviate less strongly from each other with different spray hole angles, due to which, as a whole, the injection pattern as a whole is made more uniform.

In a preferred design, the entrance into the spray hole is rounded with a radius of 8 per cent to 15 per cent of the diameter of the corresponding spray hole. Thus, particularly good results are obtained with smaller spray holes.

As further development of the inventive concept, the boundary layer can be further influenced in the manner that the transition from the rounding to the conical seat surface forms an edge. This edge then forms a separation edge which favors the development of a double-deflected flow with minimum pressure loss.

Optimal results are obtained with the separation edge if the entrance into the spray hole is rounded with a radius of 18 per cent to 25 per cent of the diameter of the corresponding spray hole. The separation edge is preferably produced in the manner that the final machining of the conical seat surface takes place only after the rounding.

A further improvement is obtained if the spray holes are limited at their exit side by a sharp edge which lies in a plane normal to the axis of the spray hole. The sharp edge again forms a separation edge which assures loss-free emergence. The normal plane furthermore has the result in the case of nozzles with nozzle-hole axes which are inclined or even inclined by a different amount to the exit surface that the emerging fuel is not deflected by an angle which furthermore is dependent on pressure. It thus contributes considerably to better emission values.

Furthermore, it can contribute to this that all spray holes are of the same length, which, in view of the rotating flow, directly affects the shape of the injection cloud.

In this way, the pressure losses in all holes are the same. This is obtained preferably upon the formation of the sharp edges, in connection with which the depth of machining can be selected in corresponding manner.

BRIEF DESCRIPTION OF THE DRAWINGS

The invention will be described and explained below with reference to the drawings, in which:

FIG. 1 shows the parts essential to the invention of a fuel-injection nozzle with two-phase needle stroke, in a simplified showing in axial section;

FIG. 2 shows the region of a spray hole in accordance with the invention, as enlarged detail;

DETAILED DESCRIPTION

Figure 3:
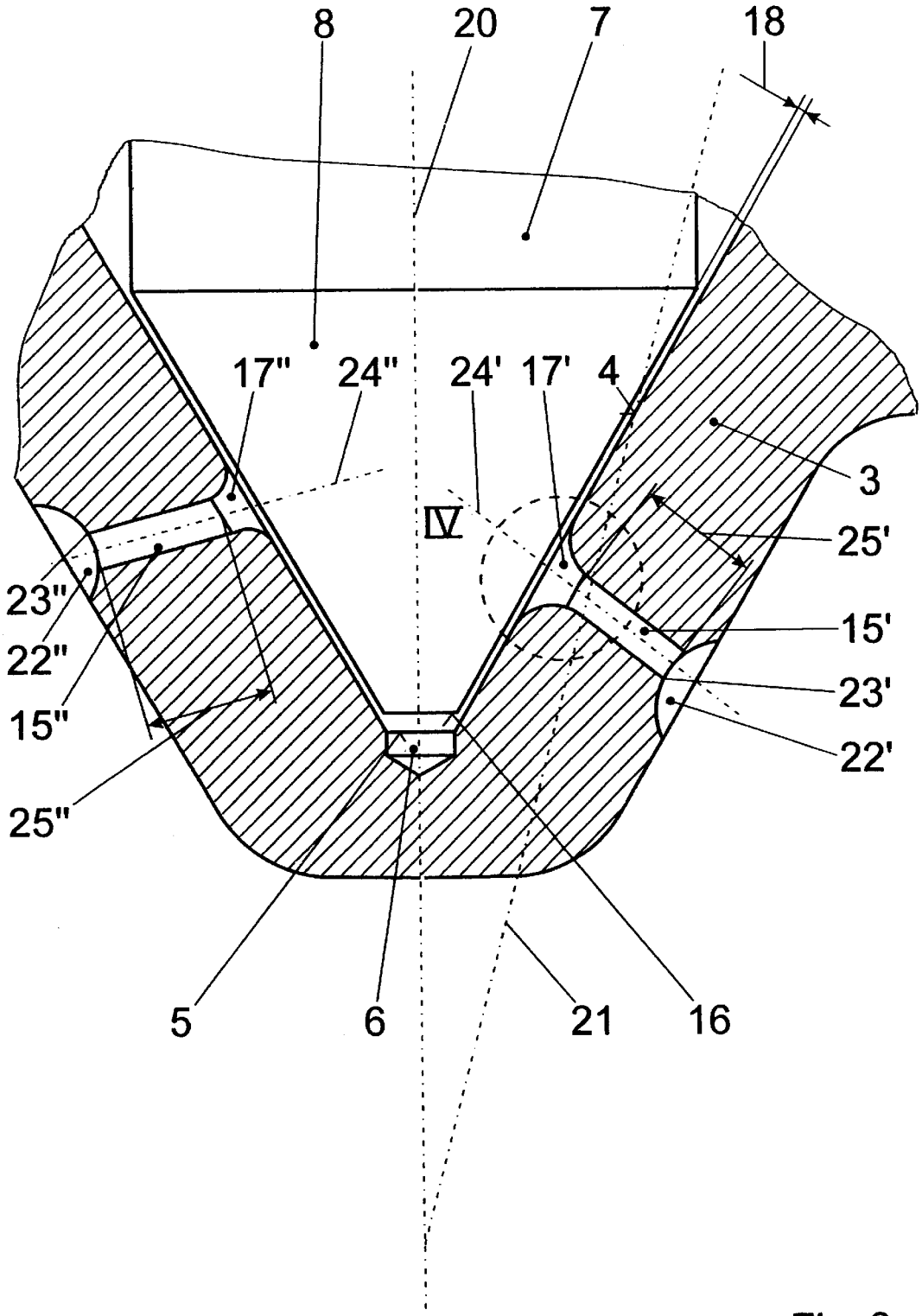
FIG. 3 shows a preferred embodiment of the injection nozzle of the invention.

In FIG. 1 the nozzle housing 1, which is connected by a cap nut 2 with the other parts of the apparatus, ends in a nozzle tip 3 which has on the inside surface thereof a conical valve seat 4 which passes with a sharp edge 5 with an angle of about 30° which leads into a blind hole 6. Within the nozzle housing 1 there is guided a pintle 7 which is pressed under spring action against the conical valve seat 4 and also has a conical end section 8, so that the end section 8 of the pintle 7, together with the valve seat 4, forms a valve, which is shown in closed position in FIG. 1.

Upon injection, the fuel is fed by an injection pump (not shown) to a channel 11 and passes into a collection space 12 from where it advances along the pintle 7 up to the valve seat 4. The pressure in the collection space 12 exerts an upward-directed force on the pintle 7, on which, initially, there acts a weak spring 9 which is surrounded by a substantially stronger spring 10. If the pump pressure increases, then the pintle 7 or its end section 8 is lifted so far from the valve seat 4 against the force of the spring 9 until it rests against the surface of the stop 13. This is the first phase of the stroke, in which the peripheral surface area of the imaginary cylinder M (formed as a continuation of the discharge or spray holes 15) is less than the cross-sectional area Q of the injection hole. Only upon further increase in the pressure of the fuel is the stop 13 then also lifted against the force of the spring 10 until it comes against an inner shoulder 14*a* of a sleeve 14. This is the second phase of the stroke, in which the surface area is greater than the cross section of the spray bore.

The nozzle tip 3 has, in the region of the valve seat 4, spray holes 15 which, when the valve is closed, is covered by the conical end section 8 of the pintle 7. This conical section 8 is limited towards the blind hole 6 by an edge 16 which also at the end of the first phase of the stroke remains below the entrance to the spray holes.

As indicated in FIG. 2, in accordance with the invention, after the first phase of the stroke of the pintle 7, the peripheral surface area M of the imaginary cylinder resulting in the extension of the spray hole 15 between its inner edge R and the surface of the conical end section 8 will now amount only to up to 30 percent (0.30) of the cross-sectional area Q of the spray hole 15 and the inner edge R of the spray hole 15 is now only the curve of the intersection of the extension of the spray hole 15 with the inner conical surface 4 of the nozzle tip 3. The inner edge R has a radius of about 8% to 25% the diameter of the spray hole 15. In this way, despite the very slight height of gap 18, there is a double deflection only in the region of the spray holes 15 (this flow pattern is described in detail in U.S. Pat. No. 5,242,118 and a throttling of the flow of fuel which, due to the high speeds which are the same around the inlet holes, and due to the rotary component of the flow leads to a particularly fine atomization.

The embodiment of an injection nozzle according to the invention for a diesel engine with direct injection and only two valves which is shown in FIG. 3 is arranged somewhat eccentric and inclined in the cylinder. In order to indicate this, the nozzle axis 20 and the cylinder axis 21 have been shown in the drawing. The parts or values already described bear again the same reference numerals, for instance the gap height 18. Since, however, the spray holes 15 differ because of the inclined position of the nozzle, the two visible ones are designated 15' and 15" and their axes 241 and 24". They form with the cylinder axis 21 approximately the same angle for which reason the spray holes 15' and 15" also emerge in the conical surface 4 under different angles; the roundings at the mouth are designated 17 ' and 17".

At the outer end of the spray holes 15 ' and 15", preferably spherical depressions 22', 22" are provided the intersection of which with the spray holes 15 ' and 15" form sharp edges 23', 23" which lie in a plane perpendicular to the axes 24', 24" of the spray holes 15 ' and 15". With a suitably selected depth of the spherical depressions 22', 22", the lengths 25', 25" of the spray holes 15 ' and 15" are the same.

Figure 4:
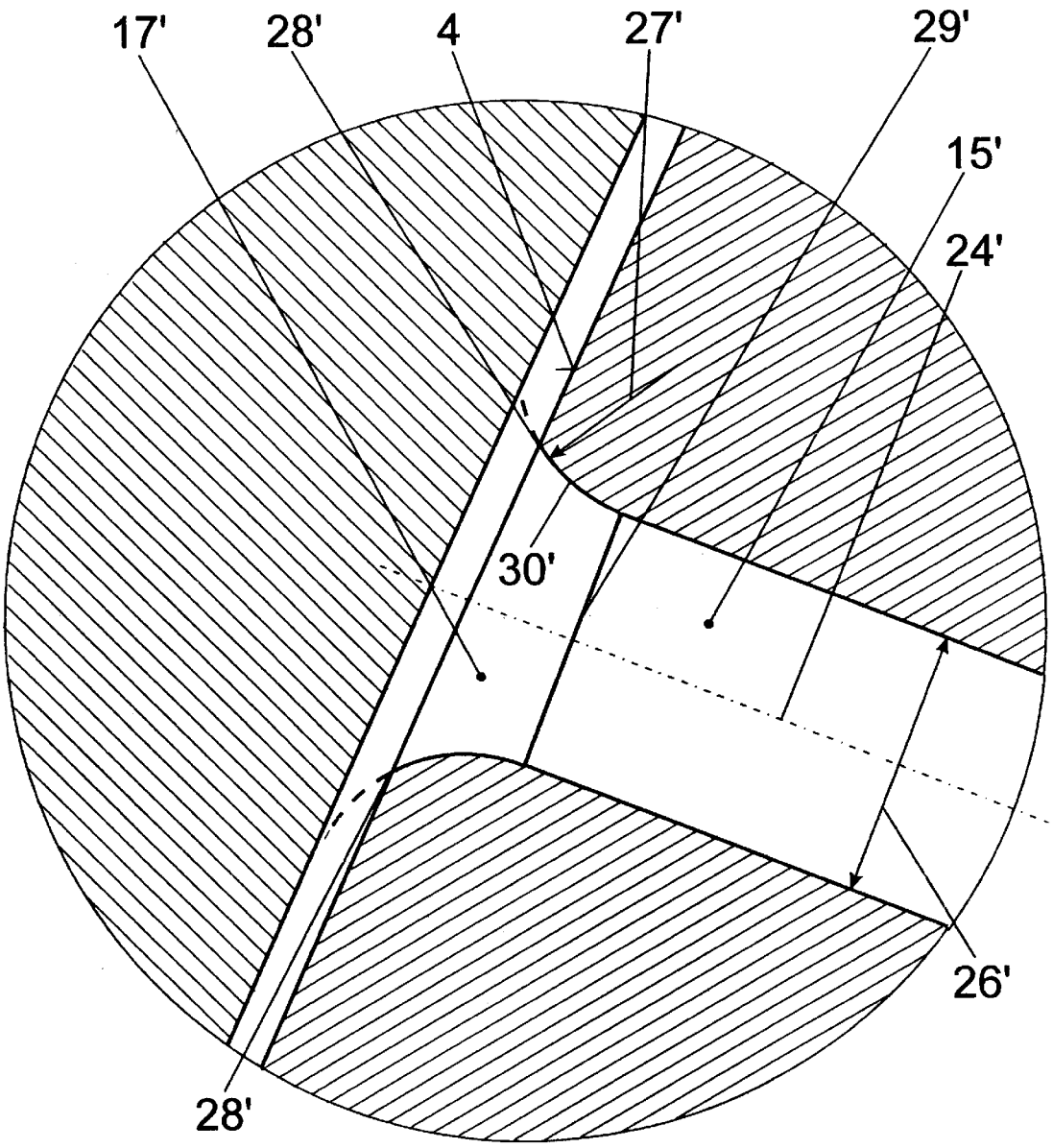
FIG. 4 is an enlarged view of the detail IV of FIG. 3.

In FIG. 4, the transition from the spray hole 15 ' to the conical surface 4 is shown in detail. The cylindrical central part of the spray hole 15 ' which has the diameter 26*f* extends inward up to the connection 29' of the rounding 17'. Its rounding radius is designated 27' and the corresponding arc 30' intersects the conical surface 4, forming with it an edge 28' which can, but need not, extend all the way around. In the event that the edge 28' extends all the way around, an unequal distribution of speed may be favorable for the development of a uniform rotary flow, if the edge 28*f* at the upper part of the rounding 171 is sharper than at its lower part. This edge 281 is produced with particular accuracy and quality of surface in the manner that first of all the rounding is machined, as is indicated by the dashed line extension of the arc 301, and only then is the conical surface 4 finish-machined.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A fuel injection nozzle having a nozzle housing terminating in a nozzle tip, a pintle guided in the housing, the pintle being pressed by spring action against a conical valve seat in the nozzle tip, the conical valve seat having a plurality of spray holes having a diameter selectively covered by a conical end of the pintle, said pintle being moved under pressure of fuel fed to the valve seat against the spring action in a first phase of stroke to define an imaginary cylinder M formed as a continuation of peripheral inner edges of the spray holes, the continuation defining a peripheral surface area of the imaginary cylinder M, the improvement which comprises: the peripheral surface area of the imaginary cylinder M is less than or equal to 0.30 Q, where Q is the cross-sectional area of each of the spray holes, and wherein the peripheral inner edge R of each of the spray holes is curved to form an entrance zone with a radius of between about 8% to 25% of the diameter of the corresponding spray hole.

2. A fuel-injection nozzle according to claim 1 wherein the peripheral edge R of each of the spray holes is curved with a radius of between about 8% to 15% of the diameter of the corresponding spray hole.

3. A fuel-injection nozzle according to claim 1 wherein a transition from each spray hole to the conical valve seat forms an edge.

4. A fuel-injection nozzle according to claim 3 wherein the entrance zone into each spray hole is rounded with a radius of 18% to 25% of the diameter of the corresponding spray hole.

5. A fuel-injection nozzle according to claim 1 wherein the spray holes have an outlet side having a sharp edge which lies in a plane normal to the axis of the spray hole.

6. A fuel-injection nozzle according to claim 4 wherein all spray holes have the same length for inclined installation in the cylinder.

* * * * *